US007938487B2

(12) United States Patent
Fismen

(10) Patent No.: US 7,938,487 B2
(45) Date of Patent: May 10, 2011

(54) TILTING FITTING FOR A CHAIR

(75) Inventor: Olav H. Fismen, Risor (NO)

(73) Assignee: HAG ASA, Oslo (NO)

( * ) Notice: Subject to any disclaimer, the term of this patent is extended or adjusted under 35 U.S.C. 154(b) by 322 days.

(21) Appl. No.: 12/169,255

(22) Filed: Jul. 8, 2008

(65) Prior Publication Data

US 2009/0015048 A1 Jan. 15, 2009

(30) Foreign Application Priority Data

Jul. 10, 2007 (NO) ..... 20073569

(51) Int. Cl.
*A47C 1/024* (2006.01)

(52) U.S. Cl. ..... 297/300.7; 297/328; 297/300.8; 297/302.6; 297/302.7; 297/303.1; 297/303.4; 297/325

(58) Field of Classification Search ..... 297/328, 297/300.7, 300.8, 302.6, 302.7, 303.1, 303.4, 297/313, 325
See application file for complete search history.

(56) References Cited

U.S. PATENT DOCUMENTS 2,677,411 A * 5/1954 Grabarczyk ..... 248/575
4,099,775 A * 7/1978 Mizelle ..... 297/302.3
4,871,208 A * 10/1989 Hodgdon ..... 297/303.1
4,890,886 A * 1/1990 Opsvik ..... 297/313
5,464,274 A * 11/1995 Golynsky et al. ..... 297/328
5,572,933 A * 11/1996 Thompson ..... 108/7
6,033,020 A * 3/2000 Ito ..... 297/302.4
6,053,574 A * 4/2000 Opsvik ..... 297/337
6,209,958 B1 * 4/2001 Thole ..... 297/302.1
6,929,327 B2 * 8/2005 Piretti ..... 297/300.2
6,983,991 B2 * 1/2006 Strona ..... 297/330

* cited by examiner

*Primary Examiner* — Laurie K Cranmer

(74) *Attorney, Agent, or Firm* — Volpe and Koenig, PC

(57) ABSTRACT

A tilting fitting device enables a chair seat to be tiltable forwards and backwards against spring force of tilt-resisting springs, the tilting fitting having an upper part that is fastenable to the chair seat and a lower part that is fastenable to a chair base and tiltably connected to the upper part, wherein the tilting resistance is adjustable by adjusting spacing between the tilt-resisting springs and distance of each spring from a respective side of a tilting axis for the upper part. An actuating element is arranged for simultaneous engagement with two support members, an actuating element, along a part of each of its two sides in the element's direction of motion. On movement of the actuating element in the longitudinal direction of the tilting axis, it is adapted to cause rotation of the support members and springs mounted thereon, thereby changing the spacing of the springs.

6 Claims, 10 Drawing Sheets

TILTING FITTING FOR A CHAIR

FIELD OF INVENTION

The present invention relates in a first aspect to a tilting fitting device for a chair to enable a chair seat when fitted to the device to be tiltable forwards and backwards against spring force of tilt-resisting springs, the tilting fitting having an upper part that is fastenable to the chair seat and a lower part that is fastenable to a chair base and tiltably connected to the upper part, wherein the tilting resistance is adjustable by adjusting spacing between the tilt-resisting springs and distance of each spring from a respective side of a tilting axis for the upper part.

A second aspect of the invention relates to a tilting fitting device for a chair, where a chair seat is tiltable forwards and/or backwards against spring force of tilt-resisting springs, the tilting fitting having an upper part fastened to the chair seat and a lower part fastened to a chair base and tiltably connected to the upper part.

BACKGROUND

A typical known solution is based on the spacing of the tilt-resisting springs being adjusted by axial movement of the springs. Such a solution has been found to have operational drawbacks for a chair user, as the necessary biasing of the springs to provide sufficient spring resistance in a neutral position (centre position) dictates that the chair seat must be tilted, and especially because of the location of the control unit for the user, i.e., on the underside, must be tilted vigorously backwards or forwards in order to release the springs for movement Because a tilting fitting, especially of the type which should be tiltable both forwards and backwards, is required to be compact, there are limited possibilities for fixing the desired tilting position, if the number of positions is to exceed one. This is partly because the tilt-resisting springs occupy a major volume of the tilting fitting, and in particular if the springs are positionable relative to one another or adjustable in another way.

SUMMARY

The object of the present invention is to remedy the outlined drawbacks of the prior art, and in connection with the first aspect of the said device mentioned in the introduction, the device, according to the invention, has the lower part provided with a first and a second pair of tilt-resisting springs, wherein the first pair of tilt-resisting springs are located on a respective side of the tilting axis, and have fixed spacing, wherein in the second pair of tilt-resisting springs, which constitute said spacing-adjustable tilt-resisting springs, each spring is eccentrically supported on or in the lower part on a respective rotatable support member, wherein each of the support members is provided with a segment of a toothed wheel, wherein an actuating element is arranged for simultaneous engagement with the two support members, the actuating element, along a part of each of its two sides in the element's direction of motion, having a row of teeth designed for engagement with a respective support member's toothed wheel or toothed wheel segment, and wherein the actuating element, when moved in the longitudinal direction of the tilting axis, is adapted to cause rotation of the support members and the springs mounted thereon, thereby changing the spacing of the springs.

According to a further embodiment, the first pair of tilt-resisting springs is designed to hold the seat in a neutral position when the seat is unloaded. This means that the first pair of tilt-resisting springs provides the basic load, and that it optionally may be pre-compressed.

According to a second embodiment, the tilting fitting and thereby the chair seat is lockable in at least one tilting position of the tilting fitting. This may expediently be realised in that, for example, the upper part of the tilting fitting is equipped with a bevelled stop for engagement with a bevelled, laterally movable engaging block.

According to a third embodiment, and also related to the second aspect of the invention, the tilting fitting is provided with a tilt lock consisting of a first tooth-equipped engaging member on the upper part, and a second tooth-equipped engaging member movable on the lower part, the two engaging members being movable away from or towards one another for, respectively, release of engagement or initiation of engagement at a desired tilting position of the upper part in relation to the lower part.

According to the second aspect of the invention of the inventive device, the chair seat is lockable in at least two tilting positions of the tilting fitting, and the tilting fitting is provided with a tilt lock consisting of a first tooth-equipped engaging member on the upper part and a second tooth-equipped engaging member movable on the lower part, the two engaging members being movable away from or towards one another for, respectively, release of engagement or initiation of engagement at a desired tilting position of the upper part relative to the lower part.

The invention will now be further explained in the form of non-limiting exemplary embodiments, with reference to the attached drawing figures.

DETAILED DESCRIPTION OF THE PREFERRED EMBODIMENTS

Figure 1:
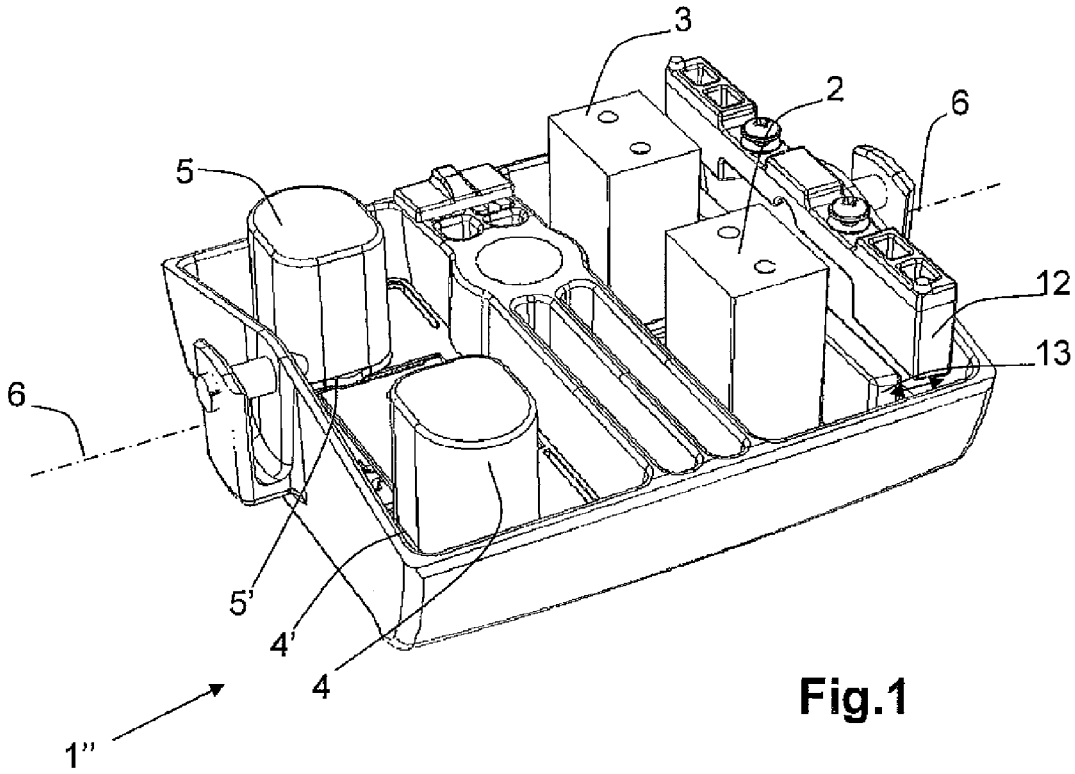
FIGS. 1 and 2 show the lower part of the tilting fitting with a first and a second pair of tilt-resisting blocks.
Figure 2:
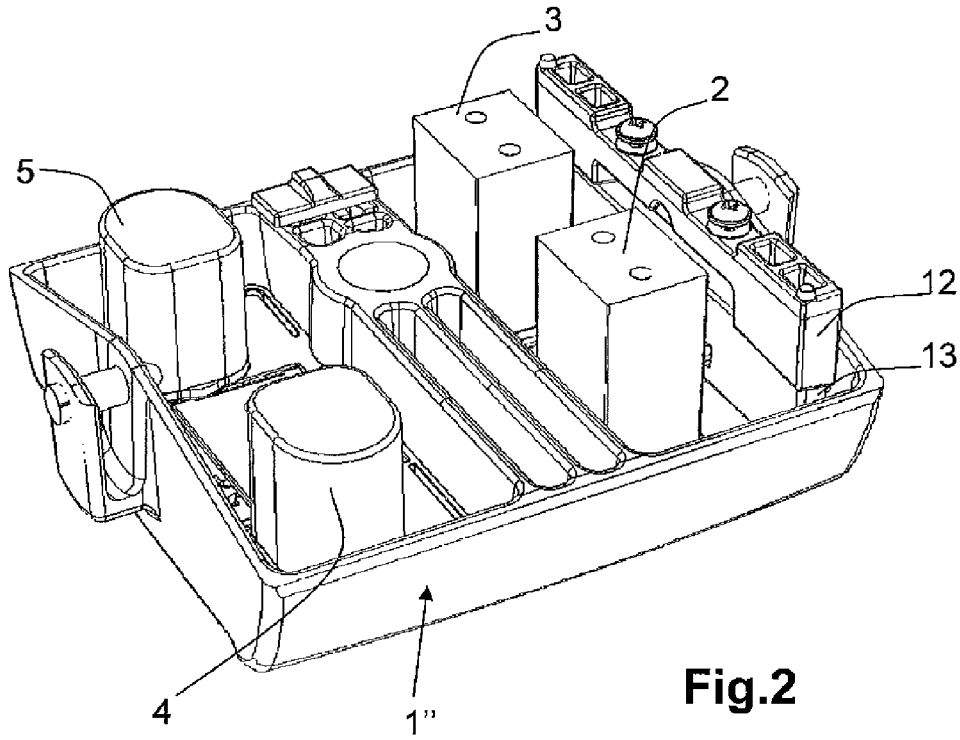
Figure 3:
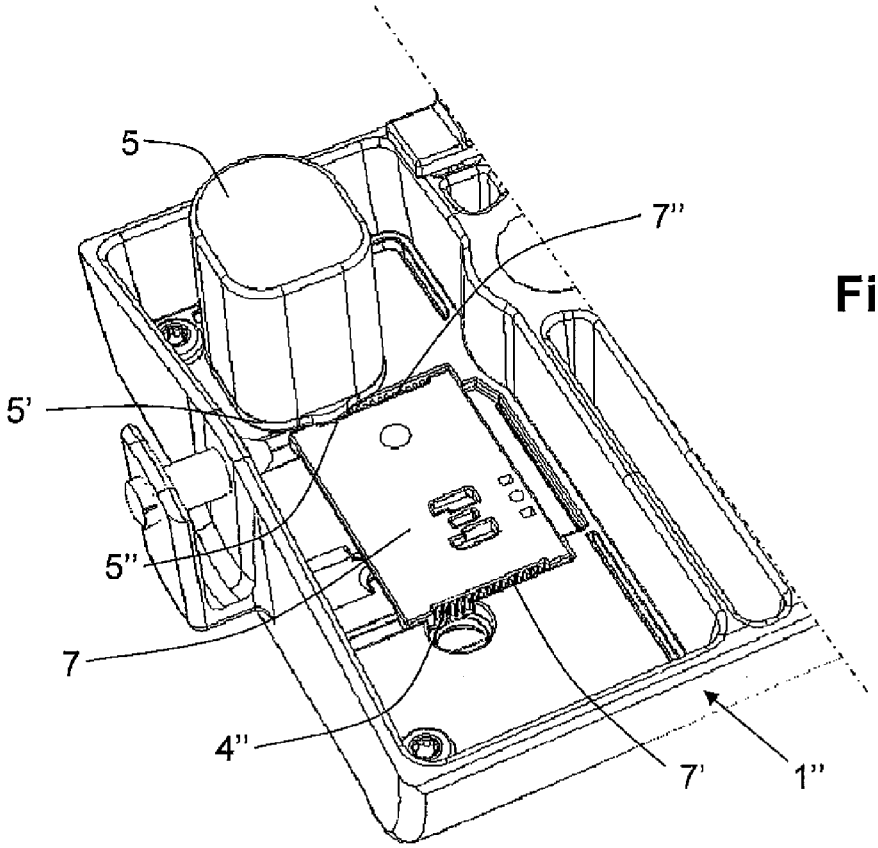
FIGS. 3 and 4 show, in an enlarged section, the part of the tilting fitting that has the second pair of tilt-resisting springs, where one of the springs with support member has been removed to clarify the structure of the adjustment mechanism.

The invention is related to a tilting fitting 1 for a chair, where the chair seat is tiltable forwards and backwards against spring force of a first pair 2, 3 and a second pair 4, 5 of tilt-resisting springs. The tilting fitting 1 has an upper part 1' that is fastenable to the chair seat (not shown) and a lower part 1" that is fastenable via a fastening sleeve 1'" to the chair base (not shown) and tiltably connected to the upper part 1'. The tilting resistance is adjustable by adjusting the spacing between the tilt-resisting springs 4, 5 and thus the distance of each spring 2, 3 from a respective side of a tilting axis 6 for the upper part.

The first pair 2, 3 of tilt-resisting springs on the lower part 1" are located on a respective side of the tilting axis 6, and these springs 2, 3 have fixed spacing. They thus ensure a nominal tilting resistance and provide a basic load, i.e., to hold the seat in a neutral position when the seat is unloaded, whilst the springs 4, 5 are designed for adjusting the tilting resistance on forward and backward tilting of the chair seat.

In the second pair 4, 5 of tilt-resisting springs, which constitute said spacing-adjustable tilt-resisting springs, each spring 4, 5 is eccentrically supported on or in the lower part on a respective rotatable support member 4', 5'. Each of the support members 4', 5' is provided with a toothed wheel 4", 5" which is adapted to synchronously engage with a respective longitudinal toothed portion 7', 7" of an actuating element 7. This actuating element forms, in reality, a two-sided toothed rack. The actuating element is preferably spring-biased by a spring 8 that is fastened to the lower part, and the actuating element 7 is movable stepwise by means of engagement between an elastically resilient engaging lug 9 and a waved engaging row 10.

Figure 4:
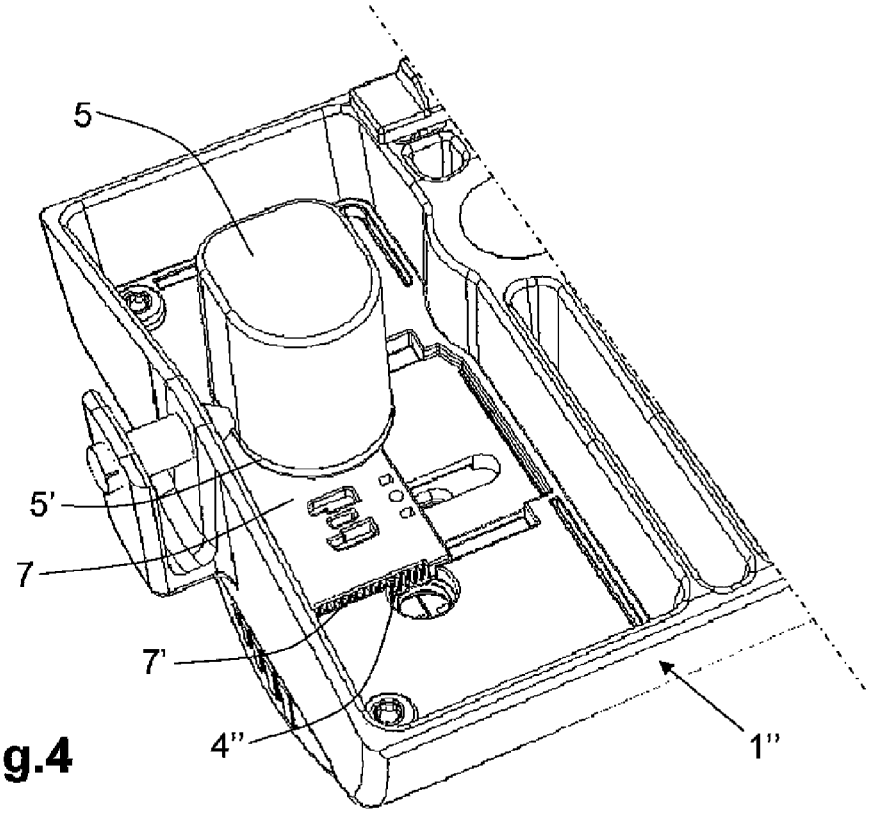
Figure 5:
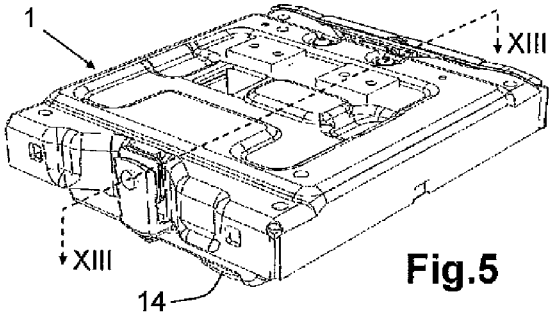
FIGS. 5, 6, 9 and 10 show the tilting fitting, as seen from above, with respective different settings of the spacing between the springs, a portion of the upper part and lower part of the tilting fitting having been removed in FIGS. 6, 9 and 10 to clarify the spacing between the springs.
Figure 6:
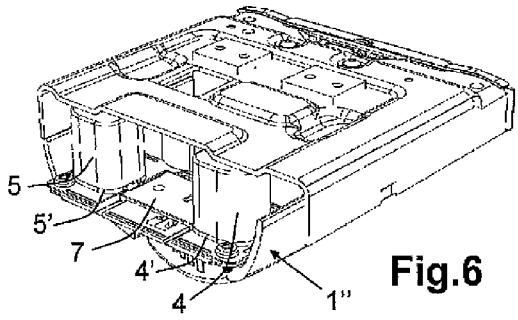
Figure 7:
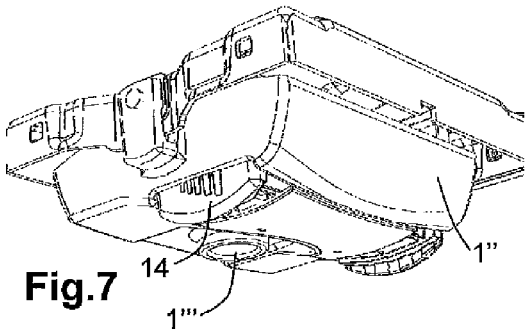
FIGS. 7, 8, 11 and 12 show the same as seen from the underside of the tilting fitting.
Figure 8:
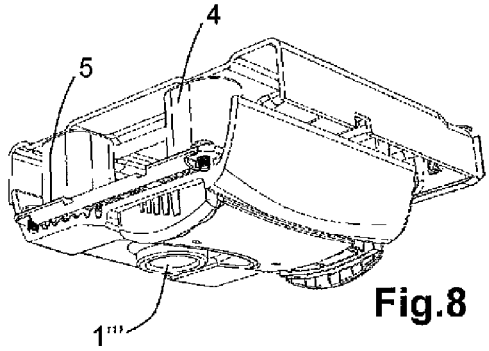
Figure 9:
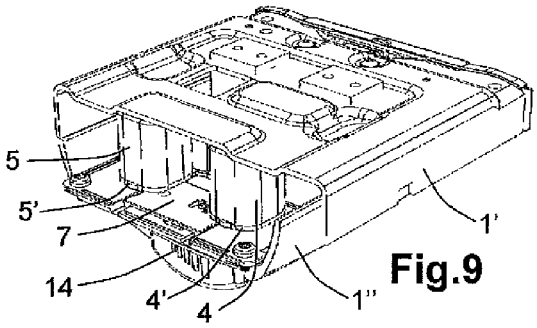
Figure 10:
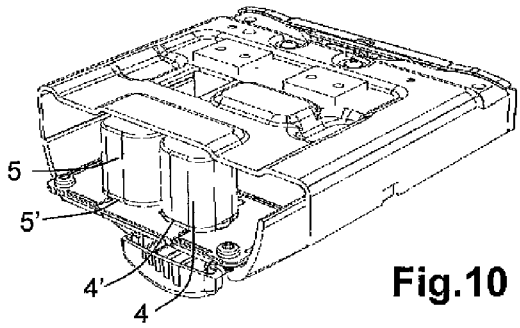
Figure 11:
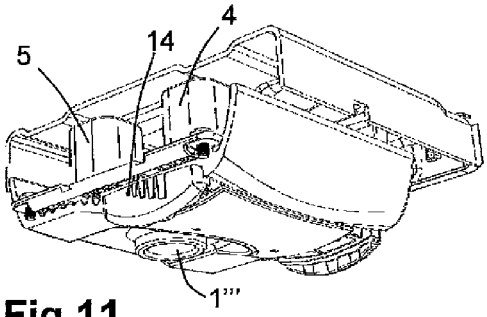
Figure 12:
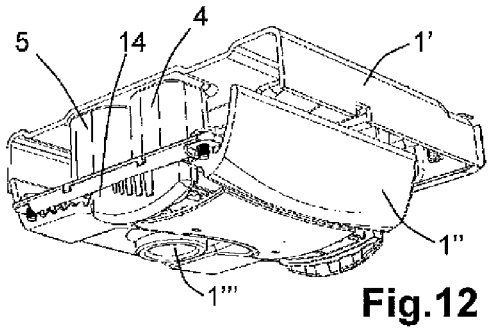
Figure 13:
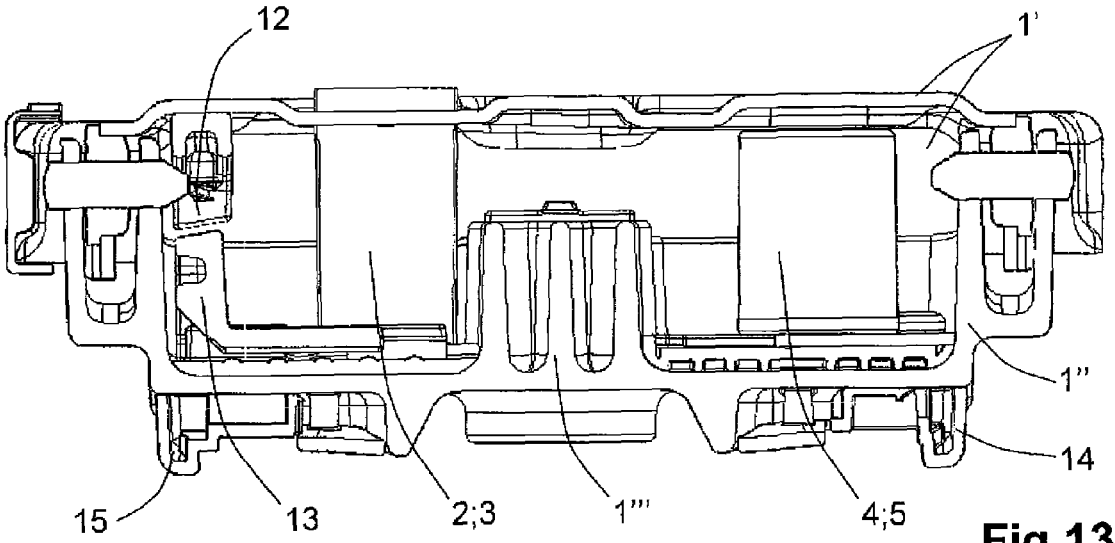
FIG. 13 shows the section XIII-XIII in FIG. 5, with a tilt lock activated.
Figure 14:
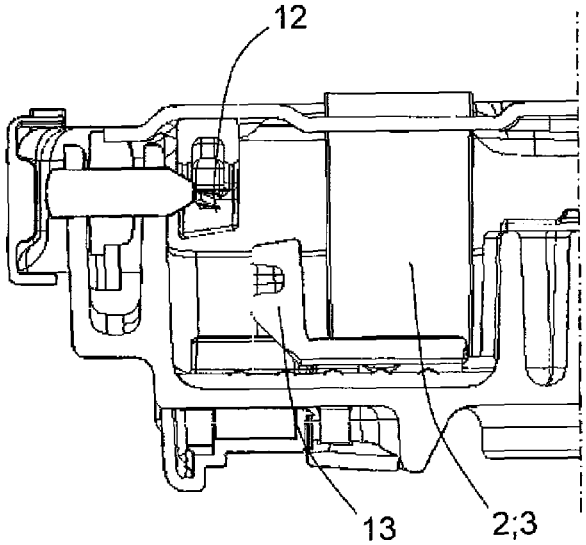
FIG. 14 shows a section of FIG. 13, but with the tilt lock inactivated.
Figure 15:
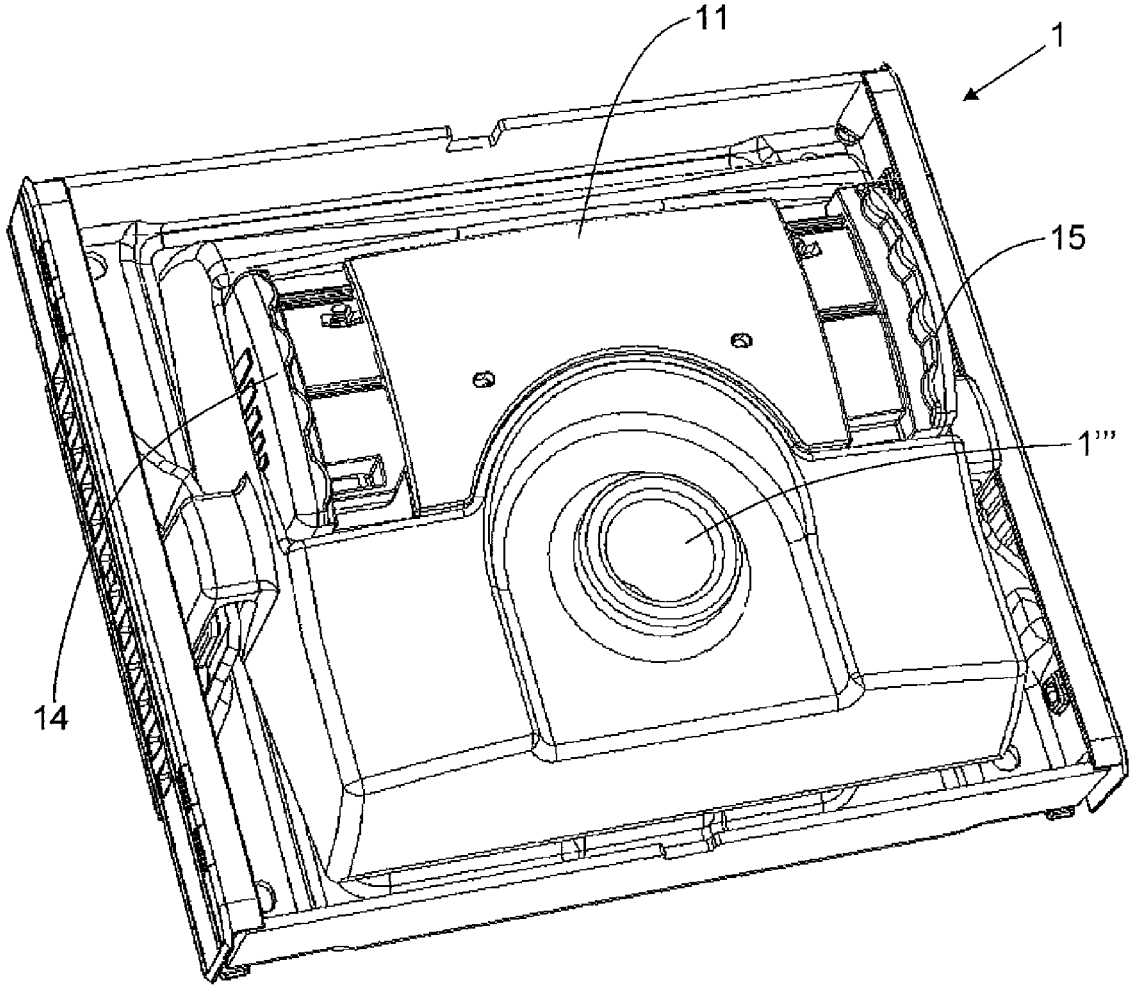
FIG. 15 is a perspective view of the tilting fitting as seen from below.
Figure 16:
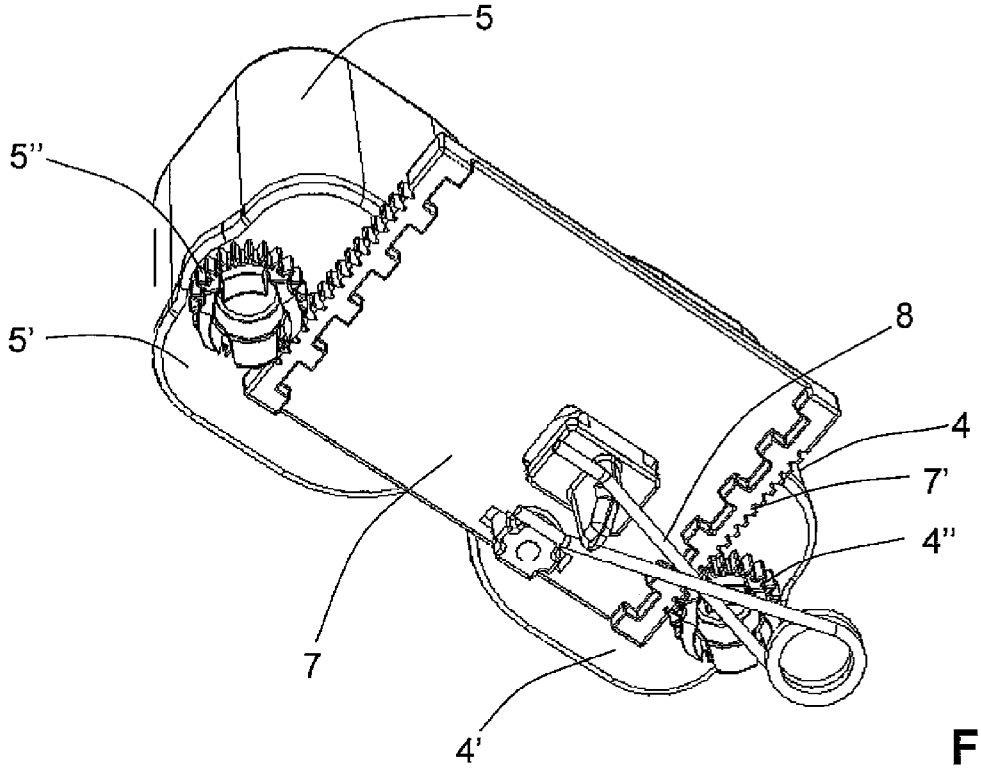
FIG. 16 shows details of the support members, their respective springs, toothed wheels/toothed wheel segments, and the actuating member.
Figure 17:
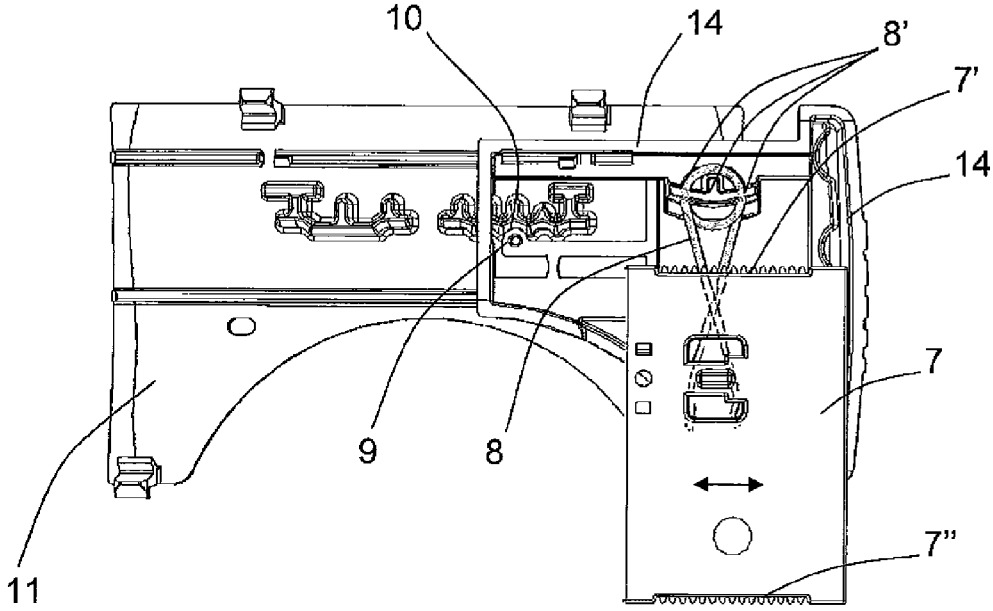
FIG. 17 shows details of the movement mechanism for the actuating member.

The control knob that the chair user must use to adjust the tilting resistance, i.e., for the movement of the actuating element, is in FIGS. 4-6, 9-15 and 17 indicated by means of the reference numeral 14. It will be seen here that a user only needs to use one single control knob for this adjustment, and that this is located on a side portion of the chair seat. If the springs 4, 5 should become slightly jammed, i.e., that the seat, e.g., is not in a neutral position, the movement of the actuating element will not be possible, but it will be possible to move the control knob 14 so that desired positioning of the engaging lug 9 relative to the row 10 of lugs becomes possible. However, the actuating element 7 will then not move at the same time, whilst, on the other hand, the spring attachment 8' for the spring 8 mounted on the control knob will move, so that the actuating element 7 is biased by the spring 8. The actuating element 7 has thus been given a sort of "order", i.e., when the jamming effect on the springs 4, 5 ceases, the spring 8 will move the element 7 to a position in which the spring 8 no longer has thrust on the element 7, whilst the engagement between the toothed row 7'; 7" and respective toothed wheel segments 4"; 5" causes the springs 4; 5 to rotate about their eccentric support into order to come into the desired spacing.

The actuating element 7 will, when moved parallel with the toothed portions 7', 7" and in the longitudinal direction of the tilting axis 6, be adapted to cause rotation of the support members 4', 5' and the springs 4, 5 mounted thereon, thereby changing the spacing between the springs 4, 5.

It will be desirable to be able to make the chair seat i.e., in reality the upper part 1' of the tilting fitting 1 lockable in at least one tilting position of the tilting fitting. This may, for example, be effected in that the upper part 1' of the tilting fitting is equipped with a bevelled stop 12 for engagement with a bevelled, laterally movable engaging block 13 which is mounted on the lower part 1" of the tilting fitting. A second control knob 15 on the opposite side of the chair, also here on the underside of the seat, is intended to operate the movable part 13 of the tilt lock. A cover that is an integral part of the lower part is indicated by the reference numeral 11.

Figure 18A:
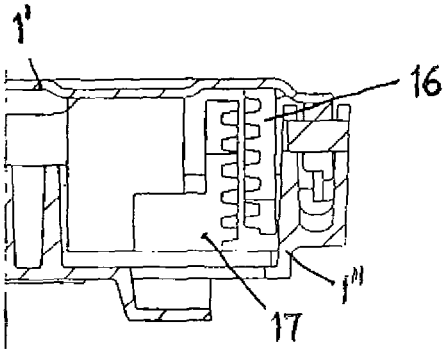
FIGS. 18*a* and 18*b* show detail of an alternative locking mechanism in respectively non-locked and locked position.
Figure 18B:
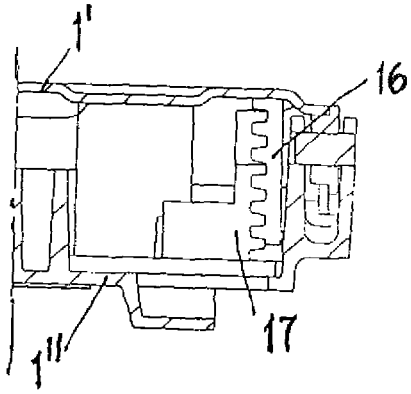
Figure 19A:
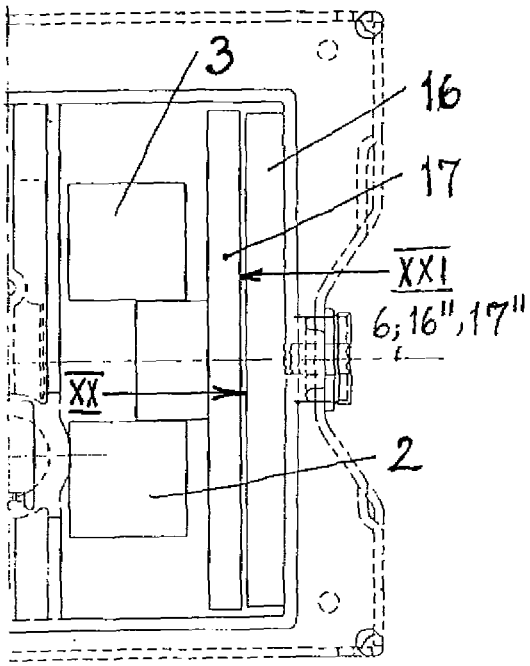
FIGS. 19*a* and 19*b* show details, as seen from above, of the alternative locking mechanism as shown in FIGS. 18*a* and 18*b*, respectively.
Figure 19B:
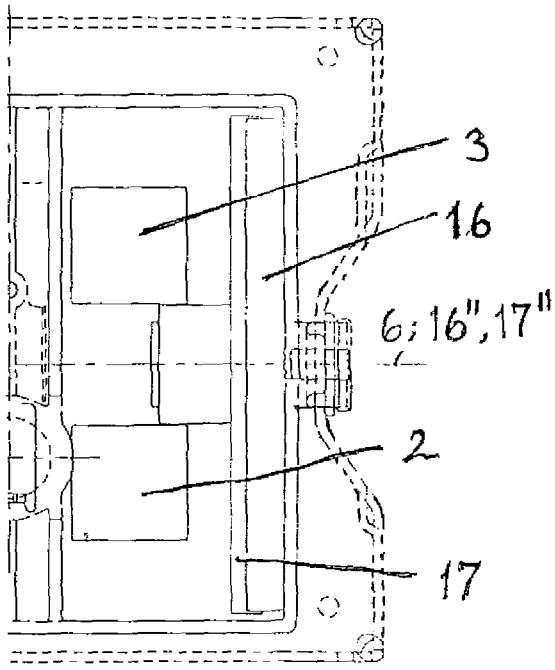
Figure 20:
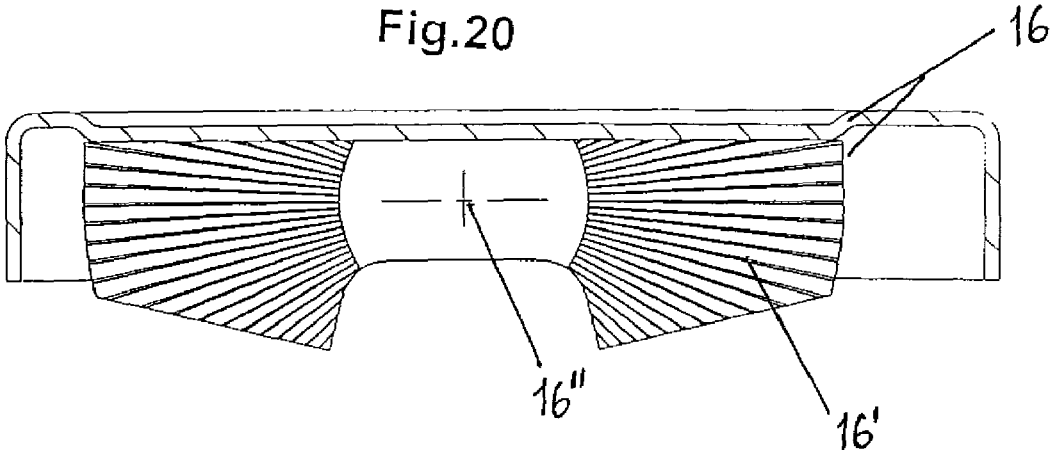
FIGS. 20 and 21 are views XX and XXI on FIG. 19*a* as seen in direction of respective arrows of the locking mechanism parts shown on FIGS. 18*a*, 18*b* and 19*a*, 19*b*.
Figure 21:
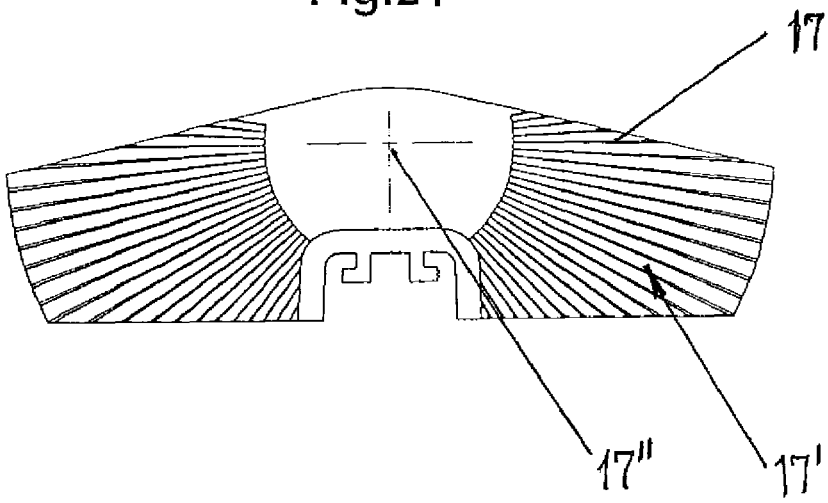
Figure 22:
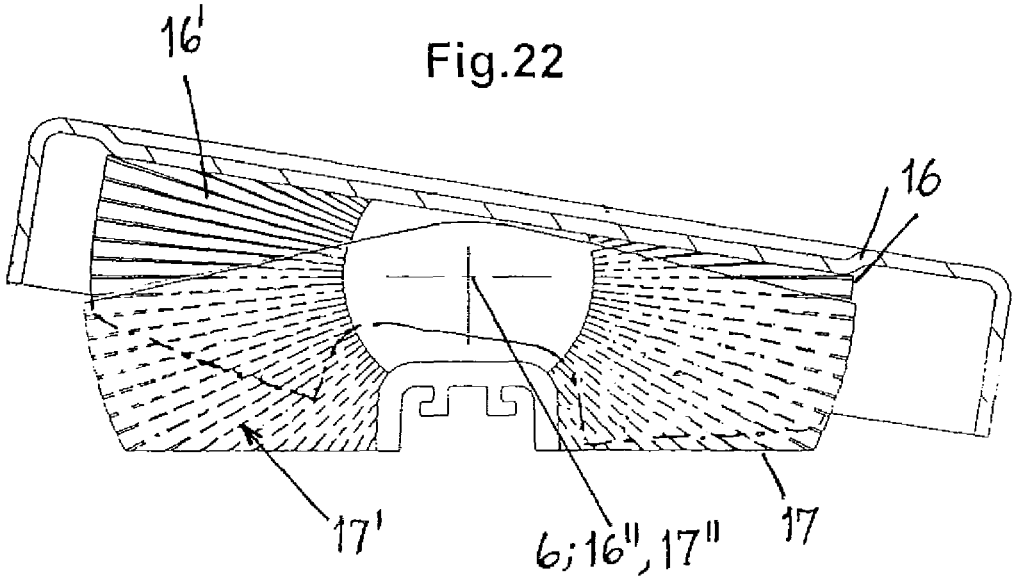
FIG. 22 shows the locking mechanism parts of FIGS. 20 and 21 mutually tilted.

As an alternative, as shown in FIGS. 18*a*-22, to allow for a plurality of tilting positions, it is conceived that the tilting fitting has a tilt lock consisting of a first tooth-equipped engaging member 16 on the upper part 1', the member 16 having a plurality of teeth 16' having a common axis 16" and being angularly spaced, and a second tooth-equipped engaging member 17 on the lower part 1", the member 17 also having a plurality of teeth 17' having a common axis 17" and being angularly spaced, so that one or more teeth 17' can selectively engage one or more interspaces or recesses between the teeth 16'. The tilt axes 16", 17" of the two members 16, 17 are coaxial, and two engaging members 16, 17 are movable relative to one another either away from or towards one another by means of the control knob 15 for, respectively, release of engagement and initiation of engagement at a desired tilting position of the upper part 1' relative to the lower part 1". In the illustrated example, the control knob 15 is connected to the engaging member 17. View XX on FIG. 19*a* indicates the member 16, and view XXI on FIG. 19*a* indicates the member 17.

Figure 23A:
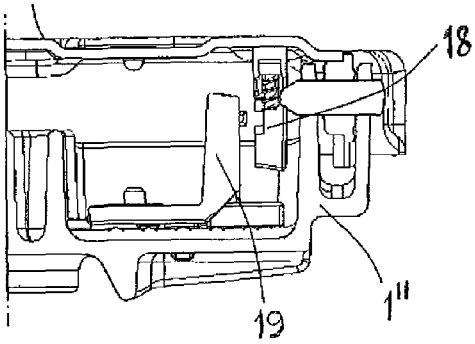
FIGS. 23*a* and 23*b* show details of a modified embodiment of the alternative locking mechanism in respectively non-locked and locked position.
Figure 23B:
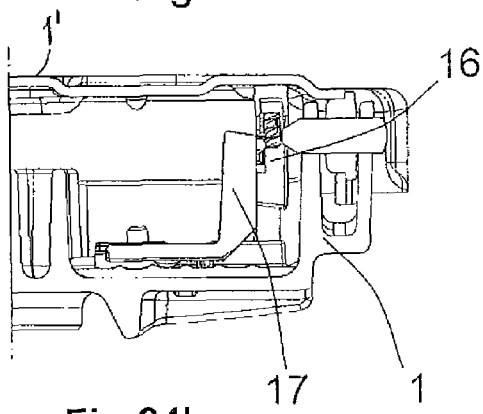
Figure 24A:
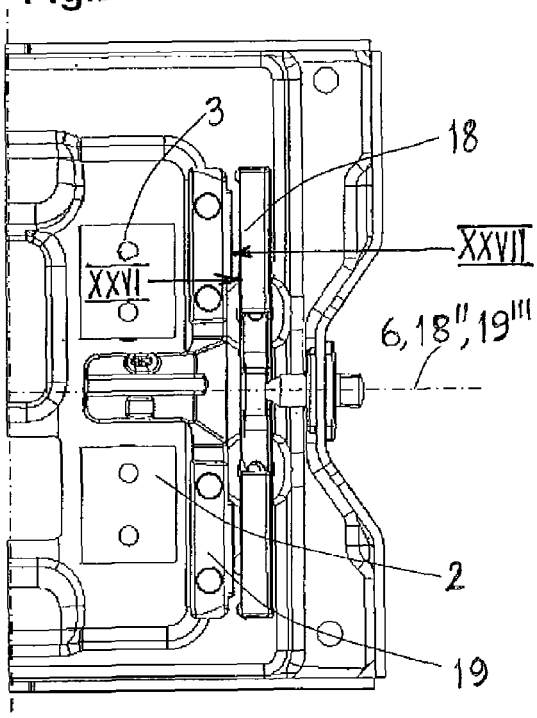
FIGS. 24*a* and 24*b* show details, as seen from above, of the alternative locking mechanism as shown in FIGS. 23*a* and 23*b*, respectively.
Figure 24B:
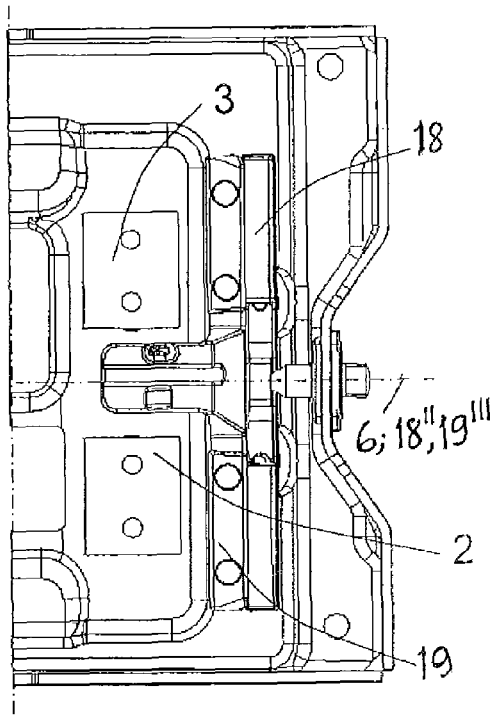
Figure 25A:
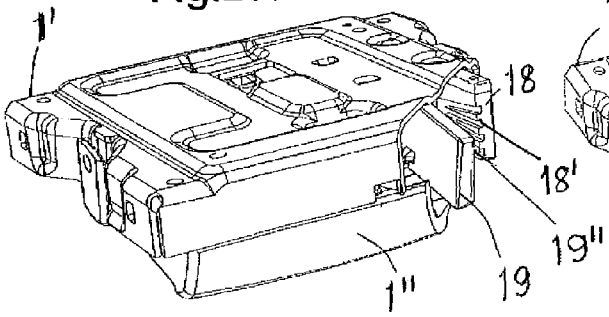
FIGS. 25*a* and 25*b* are perspective views from above of the tilting mechanism of FIGS. 23*a*, 23*b*, 24*a* and 24*b* with the parts of the mechanism mutually tilted, but unlocked on FIG. 25*a*, and locked on FIG. 25*b*.
Figure 25B:
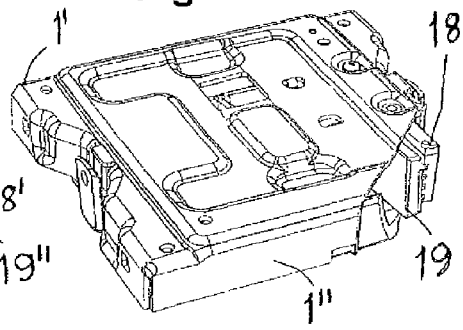
Figure 26:
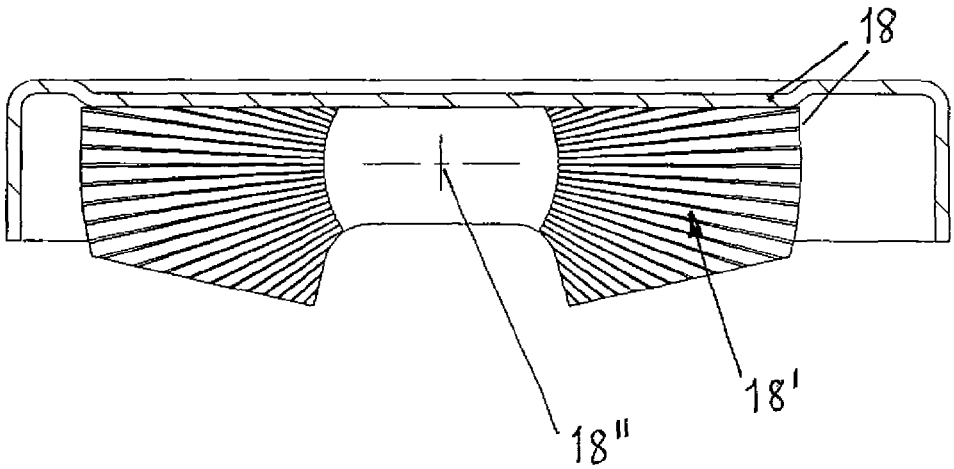
FIGS. 26 and 27 are views XXVI and XXVII on FIG. 24*a* as seen in direction of respective arrows of the locking mechanism parts shown on FIGS. 23*a*, 23*b*; 24*a*, 24*b* and 25*a*, 25*b*.
Figure 27:
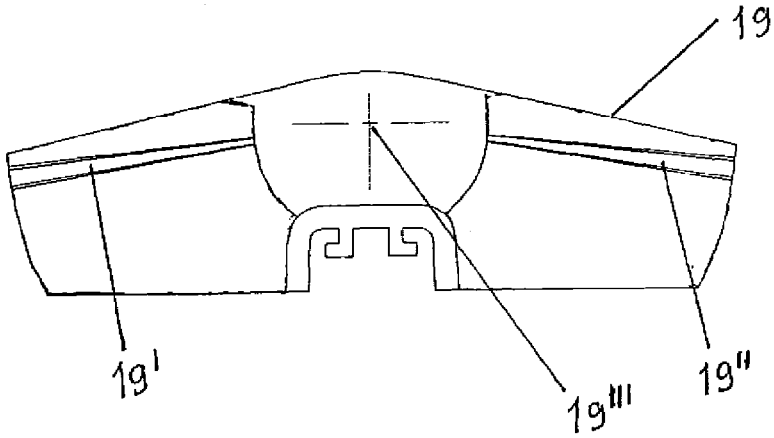
Figure 28:
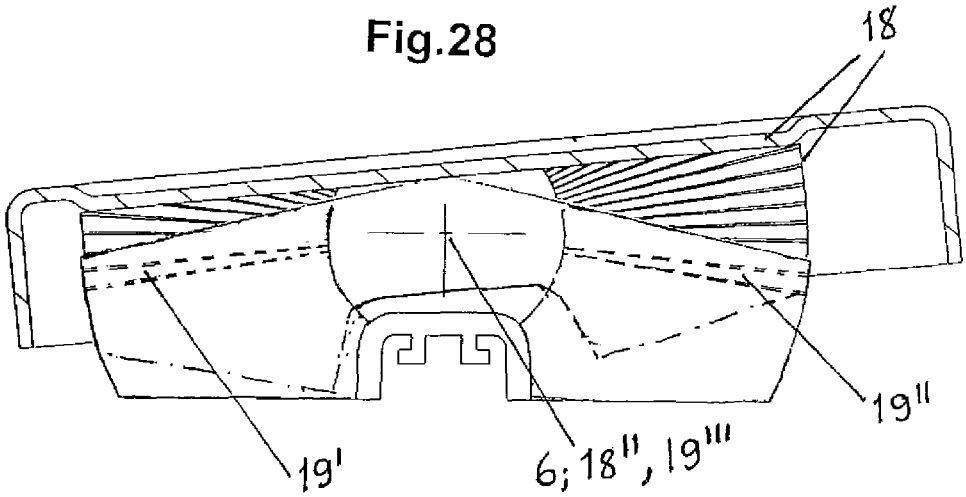
FIG. 28 shows the locking mechanism parts of FIGS. 26 and 27 mutually tilted.

As a modification of the embodiment of FIGS. 18*a*-22, it is now referred FIGS. 23*a*-28. To allow for a plurality of tilting positions, it is conceived that the tilting fitting has a tilt lock consisting of a first tooth-equipped engaging member 18 on the upper part 1', the member 18 having a plurality of teeth 18' having a common axis 18" and being angularly spaced. This member 18 is of same structure as the member 16 described above. Further, the tilt-lock has a second tooth-equipped engaging member 19 on the lower part 1" The member 19 has in this case, contrary to member 17, just a pair of teeth 19', 19" having a common axis 19'" and being located on either half sector of the member 19, so that so that one or both of the teeth 19', 19" can selectively engage one or two interspaces or recesses between the teeth 18'. The tilt axes 18", 19'" of the two members 18, 19 are coaxial, and two engaging members 19, 19 are movable relative to one another either away from or towards one another by means of the control knob 15 for, respectively, release of engagement or initiation of engagement at a desired tilting position of the upper part 1' relative to the lower part 1". View XXVI on FIG. 24*a* indicates the member 18, and view XXVII on FIG. 24*a* indicates the member 19. In the illustrated example, the control knob 15 is connected to the engaging member 19.

What is claimed is:

1. A tilting fitting device for a chair to enable a chair seat when fitted to the device to be tiltable forwards and backwards against spring force of tilt-resisting springs, the tilting fitting device having an upper part that is fastenable to the chair seat and a lower part that is fastenable to a chair base and tiltably connected to the upper part, wherein the lower part is provided with a first and a second pair of tilt-resisting springs;

wherein the upper part has a tilting axis about which the upper part is tiltable relative to the lower part, the tilting axis extending from one side of the device adjacent the first pair of springs to the other side adjacent the second pair of springs;

wherein the springs of the first pair of tilt-resisting springs are located on a respective side of the tilting axis, and have fixed spacing;

wherein the springs of the second pair of tilt-resisting springs are located on a respective side of the tilting axis;

wherein the tilting resistance of the device is adjustable by adjusting spacing between the second pair of tilting springs and thereby distance of each spring thereof from a respective side of the tilting axis;

wherein in the second pair of tilt-resisting springs, which constitute said spacing-adjustable tilt-resisting springs, each spring is eccentrically supported on or in the lower part on a respective rotatable support member;

wherein each of the support members is provided with a segment of a toothed wheel;

wherein an actuating element is arranged for simultaneous engagement with the two support members, the actuating element, along a part of each of its two sides in the element's longitudinal direction of motion, having a row of teeth designed for engagement with a toothed wheel or a toothed wheel segment of a respective one of the support members; and wherein the actuating element, when moved in the longitudinal direction of the tilting axis, is adapted to cause rotation of the support members and the springs mounted thereon, thereby changing the spacing of the springs.

2. A device according to claim 1, wherein the first pair of tilt-resisting springs is designed to hold the seat in a neutral position when the seat is unloaded.

3. A device according to claim 1, wherein the first pair of tilt-resisting springs is pre-compressed.

4. A device according to claim 1, wherein the tilting fitting device and thereby a chair seat attachable thereto are lockable in at least one tilting position of the tilting fitting.

5. A device according to claim 4, wherein the upper part of the tilting fitting device is equipped with a bevelled stop for engagement with a bevelled, laterally movable engaging block.

6. A device according to claim 4, wherein the tilting fitting device is provided with a tilt lock consisting of a first tooth-equipped engaging member on the upper part, and a second tooth-equipped engaging member movable on the lower part, the two engaging members being movable away from or towards one another for, respectively, release of engagement or initiation of engagement at a desired tilting position of the upper part relative to the lower part.

* * * * *